US008067685B2

(12) United States Patent
Parish

(10) Patent No.: US 8,067,685 B2
(45) Date of Patent: Nov. 29, 2011

(54) STRINGED INSTRUMENT UTILIZING SYMPATHETIC VIBRATIONS

(76) Inventor: Preston Parish, Torrington, CT (US)

( * ) Notice: Subject to any disclaimer, the term of this patent is extended or adjusted under 35 U.S.C. 154(b) by 32 days.

(21) Appl. No.: 12/683,850

(22) Filed: Jan. 7, 2010

(65) Prior Publication Data

US 2011/0162505 A1 Jul. 7, 2011

(51) Int. Cl.
*G10H 3/18* (2006.01)

(52) U.S. Cl. ..... 84/726; 84/294; 84/173

(58) Field of Classification Search ..... 84/173, 84/294, 726
See application file for complete search history.

(56) References Cited

U.S. PATENT DOCUMENTS 3,696,698 A * 10/1972 Kaminsky ..... 84/173
4,372,187 A 2/1983 Berg
4,909,121 A 3/1990 Usa et al.
5,142,961 A * 9/1992 Paroutaud ..... 84/726
5,198,604 A 3/1993 Higashi et al.
5,315,060 A * 5/1994 Paroutaud ..... 84/726
5,648,629 A 7/1997 Kozuki
5,854,438 A 12/1998 Assayag et al.
5,981,861 A * 11/1999 Van Delinder et al. ..... 84/743

FOREIGN PATENT DOCUMENTS

WO WO 9719441 A1 * 5/1997

* cited by examiner

*Primary Examiner* — Jeffrey Donels
(74) *Attorney, Agent, or Firm* — Jon Fallon, Esq.

(57) ABSTRACT

Embodiments of the present invention relate to a musical instrument having a plurality of strings, wherein a global fundamental tone produces a sympathetic resonance in one or more of the plurality of strings. In accordance with one embodiment of the present invention, a stringed musical instrument comprises a plurality of strings, and a vibration inducing device configured to create a global fundamental tone upon demand by a user, wherein at least a first string of the plurality of strings controllably produces a sympathetic resonance in response to the global fundamental tone.

20 Claims, 3 Drawing Sheets

200

STRINGED INSTRUMENT UTILIZING SYMPATHETIC VIBRATIONS

BACKGROUND

1. Field of the Invention

Embodiments of the present invention generally relate to a musical instrument utilizing sympathetic vibrations to create a unique sound. More specifically, embodiments of the present invention relate to a musical instrument having a plurality of strings, wherein a global fundamental tone produces a sympathetic resonance in one or more of the plurality of strings.

2. Description of the Related Art

The world of musical technology is constantly evolving and adapting to meet the changing styles and tastes of the music industry. From rock to rap, hip-hop and R&B to classical, different genres attract different people with different tastes, and as such, call for different musical sounds.

A sympathetic resonance phenomenon occurs occasionally with stringed instruments. Generally, when a string is free, it is liable to vibrate according to one of its vibration modes, often corresponding to a harmonic resonance. When a free string of a musical instrument is in the vicinity of a vibrating string, the free string may vibrate through harmonic sympathy with the excited string. This phenomenon, known as "sympathetic resonance," does occur naturally during the playing of some other instruments. However, the phenomenon is almost always considered to be undesirable, contaminating a pure tone and constituting cacophonous undertones. As such, these other instruments make attempts to limit or restrict the intensity and effect of sympathetic vibrations using damping mechanisms or the like.

Thus, there is a need for a stringed instrument utilizing controlled and emphasized sympathetic vibrations.

SUMMARY

Embodiments of the present invention relate to a musical instrument having a plurality of strings, wherein a global fundamental tone produces a sympathetic resonance in one or more of the plurality of strings. In accordance with one embodiment of the present invention, a stringed musical instrument comprises a plurality of strings, and a vibration inducing device configured to create a global fundamental tone upon demand by a user, wherein at least a first string of the plurality of strings controllably produces a sympathetic resonance in response to the global fundamental tone.

In accordance with another embodiment of the present invention, a piano comprises a plurality of keys, each key associated with one of a plurality of strings, and a vibration inducing device configured to vibrate at least a first string of the plurality of strings upon depression of one of the plurality of keys, wherein a second string of the plurality of strings produces a sympathetic resonance in response to the vibration of the first string.

In accordance with yet another embodiment of the present invention, A method of playing a stringed instrument utilizing sympathetic vibrations, comprises providing a stringed instrument, comprising a plurality of strings, and a vibration inducing device configured to vibrate at least a first string of the plurality of strings upon demand by a user, wherein a second string of the plurality of strings produces a sympathetic resonance in response to the vibration of the first string; engaging the vibration inducing device to vibrate the first string; and inducing a sympathetic vibration of the second string.

BRIEF DESCRIPTION OF THE DRAWINGS

So the manner in which the above recited features of the present invention can be understood in detail, a more particular description of embodiments of the present invention, briefly summarized above, may be had by reference to embodiments, which are illustrated in the appended drawings. It is to be noted, however, the appended drawings illustrate only typical embodiments of embodiments encompassed within the scope of the present invention, and, therefore, are not to be considered limiting, for the present invention may admit to other equally effective embodiments, wherein.

Figure 1A:
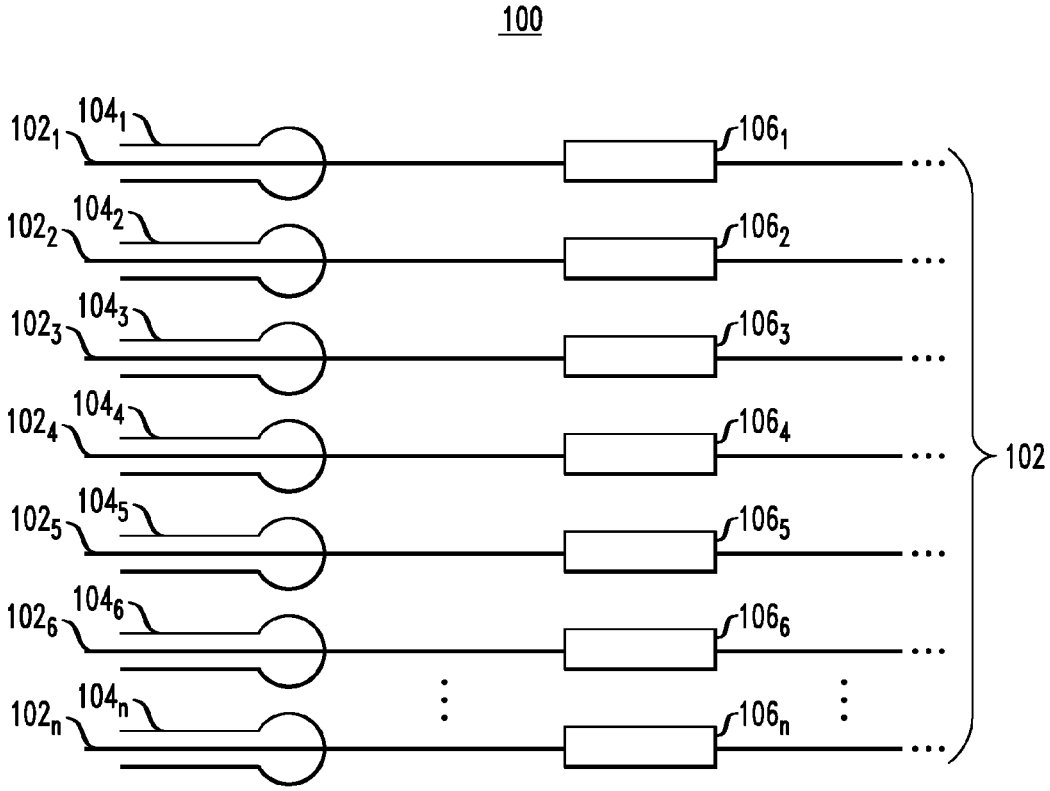
FIG. 1*a* depicts a portion of a stringed instrument in accordance with one embodiment of the present invention.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

DETAILED DESCRIPTION

In the following detailed description, numerous specific details are set forth in order to provide a thorough understanding of exemplary embodiments or other examples described herein. However, it will be understood these examples may be practiced without the specific details. In other instances, well-known methods, procedures, and components have not been described in detail, so as to not obscure the following description. Furthermore, the examples disclosed herein are for exemplary purposes only and other examples may be employed in lieu of, or in combination with, the examples disclosed.

Embodiments of the present invention generally relate to a musical instrument utilizing sympathetic vibrations to create a unique sound. More specifically, embodiments of the present invention relate to a musical instrument having a plurality of strings, wherein a global fundamental tone produces a sympathetic resonance in one or more of the plurality of strings.

As used herein, the term "stringed instrument" or "stringed musical instrument" should be broadly interpreted to include any musical instrument having a plurality of strings, the resonance of which, create musical or audible tones. These terms should not be interpreted in their literal or musical instrument classification sense (e.g., many persons consider a piano to be a percussion instrument, but for purposes of the disclosure herein, should be considered a "stringed instrument").

As used herein, a "global fundamental tone" may comprise any vibration inducing source for inducing mechanical vibration of one or more sympathetically vibrating mediums, in accordance with embodiments of the present invention. For example, a global fundamental tone may comprise a speaker magnet mounted on a soundboard of an instrument, a sound produced from an excitation of a first string of a plurality of strings, or the like. A global fundamental tone may also be generated by 'global soundboard excitation,' which may comprise a pseudo-silent effect within the instrument itself, wherein a tone would resonate to an extremely reduced level of audibility (i.e., naturally unamplified), but would yield sympathetic vibrations in one or more of the proximal strings.

FIG. 1*a* depicts a portion of a stringed instrument in accordance with one embodiment of the present invention. The stringed instrument 100 generally comprises a plurality of strings $\mathbf{102}_1$, $\mathbf{102}_2$, $\mathbf{102}_3$, $\mathbf{102}_4$, $\mathbf{102}_5$, $\mathbf{102}_6$, $\mathbf{102}_n$, where n is any number suitable for embodiments of the present invention (collectively referenced as strings 102). The strings 102 may comprise any material feasible for embodiments of the present invention, including but not limited to: metals and metal alloys, such as aluminum, tin, steel, brass, bronze, stainless steel, chromium, nickel, copper, gold, silver, platinum, zinc, iron, and tungsten, and alloys thereof; polymeric materials, such as nylon and Kevlar; natural fibers, such as silk, hair, and catgut; combinations thereof and the like.

In some embodiments, each of the plurality of strings 102 may be equipped with a damper $\mathbf{106}_1$, $\mathbf{106}_2$, $\mathbf{106}_3$, $\mathbf{106}_4$, $\mathbf{106}_5$, $\mathbf{106}_6$, $\mathbf{106}_n$, where n is either equal to or less than the number of strings above (collectively referenced as dampers 106). The dampers 106 are configured to prevent or control vibration of its corresponding string(s) 102.

As depicted in FIG. 1*a*, in accordance with one embodiment of the present invention, a single damper 106 may be configured to engage a single string 102. However, other configurations may be utilized without departing from the scope of embodiments of the present invention, including but not limited to utilizing a single damper 106 in connection with more than one string 102, in accordance with a predetermined pattern of known harmonics. Alternatively, for example, with a traditional bass having four strings tuned such that the base tension in each string places no two strings on the same harmonic frequency, no damper may be necessary. However, in such an embodiment, a user may utilize a fingertip or other device at various positions along the fret board of the bass guitar to act as a damper, and provide the benefits of such features as described herein.

Figure 1B:
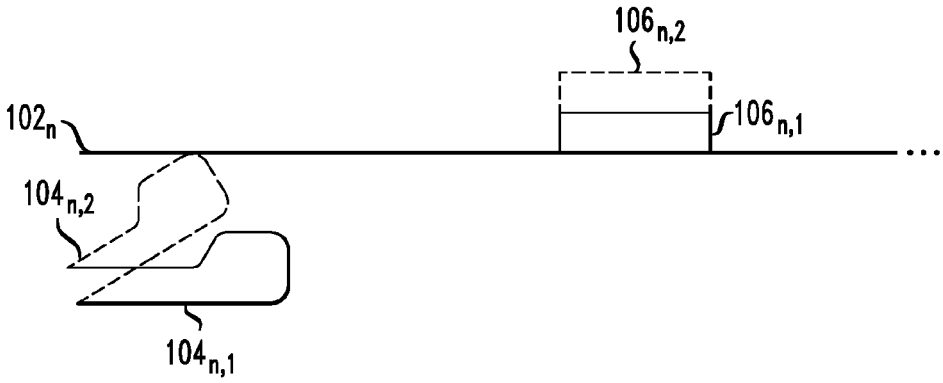
FIG. 1*b* depicts a side view of the stringed instrument of FIG. 1*a;*

Any of the dampers 106 may assume either a free position, in which the damper 106 is not engaged with any of the strings 102, or in an engaged position, in which the damper 106 is engaged with any one or more of the strings 102 to prevents or minimize the string 102 from any significant or undesired vibration. As shown in FIG. 1*b*, the damper 106 in solid lines exists in its engaged position (assigned reference numeral $\mathbf{106}_{n,1}$), and in dashed lines in its free position (assigned reference numeral $\mathbf{106}_{n,2}$).

In certain embodiments, the position of any one or more of the dampers 106 may be selected by way of a damper toggle. A damper toggle may selectively (e.g., at the discretion and/or demand of a user) change the position of one or more dampers 106. In accordance with one embodiment of the present invention, a damper toggle may comprise an arm or lever connected at one end to one or more dampers 106 and at another end to a foot pedal, a key on a keyboard, other triggering mechanism or the like. In another exemplary embodiment of the present invention, the damper toggle may comprise a traditional sustain pedal, which lifts all dampers 106, with the option of a latch that disables and lifts all the dampers 106 until the latch is released. In yet a further exemplary embodiment, a damper toggle may comprise a latch mechanism for enabling a user to freeze a chord, on a piano, which would lock the dampers 106 in an 'off' position after a series of notes are pressed on the keyboard.

Optionally, certain embodiments further comprise a vibration inducing device, or a plurality of vibration inducing devices $\mathbf{104}_1$, $\mathbf{104}_2$, $\mathbf{104}_3$, $\mathbf{104}_4$, $\mathbf{104}_5$, $\mathbf{104}_6$, $\mathbf{104}_n$, where n is either equal to or less than the number of strings above (collectively referenced as a vibration inducing device 104). The vibration inducing device 104 may comprise any device suitable for embodiments of the present invention. For example, as shown, the vibration inducing device 104 may comprise a device capable of producing or evoking vibratory motion in any one or more strings 102, including but not limited to a hammer (as in a piano), a plectrum (as utilized in connection with guitar-playing), a bowing, a computerized waveform or signal generator, or the like.

The vibration inducing device 104 may be configured in any manner, depending on the nature of the musical instrument 100. For example, in the context of a piano, it may be advantageous to provide the vibration inducing device 104 as a hammer positioned above string 102, in accordance with common piano construction. Alternatively, however, the vibration inducing device 104 may be situated in any manner, so as to accommodate the embodiments of the present invention, including for example, as a portion of the anchor of the string on the musical instrument, so as to induce vibration from one end of the string, or applied globally to a soundboard.

It should be appreciated by embodiments of the present invention, although separate vibration inducing devices 104 and dampers 106 are described, it may be beneficial to provide a single apparatus capable of both inducing vibration and dampening. For example, in one embodiment, where the stringed musical instrument comprises a piano, a hammer may be used to vibrate a string with a piano key is depressed. However, when the piano key is not depressed, the hammer remains on the string in a damping fashion.

As depicted in the embodiment shown in FIG. 1*b*, the vibration inducing device 104 may assume either a free position (shown in solid lines as $\mathbf{104}_{n,1}$) in which the vibration inducing device 104 is not engaged or otherwise in contact with any of the strings 102, or an engaged position (shown in dashed lines as $\mathbf{104}_{n,2}$), in which the vibration inducing device 104 is engaged with any one or more of the strings 102.

In one example of operation, referring to FIG. 1*a*, if the damper $\mathbf{106}_4$ is set into its free position and removed from engagement with the string $\mathbf{102}_4$, a contact from vibration inducing device $\mathbf{104}_4$ would set the string $\mathbf{102}_4$ into vibratory motion, thus allowing the string $\mathbf{102}_4$ to emit a fundamental tone. Should the scenario be repeated with dampers $\mathbf{106}_3$ and $\mathbf{106}_5$ being set in their free positions, depending on the factors discussed herein (e.g., frequency, amplitude, etc.), strings $\mathbf{102}_2$ and $\mathbf{102}_5$ may resonate sympathetically and without direct contact from either of vibration inducing devices $\mathbf{104}_3$ and $\mathbf{104}_5$, thus emitting sympathetic tones. In the case where the factors are not ripe for strings $\mathbf{102}_3$ and/or $\mathbf{102}_5$ to resonate sympathetically (e.g., tensions and/or frequencies are different by more or less than a predetermined amount or interval), the strings $\mathbf{102}_3$ and/or $\mathbf{102}_5$ may not resonate and/or emit sympathetic tones, even with dampers $\mathbf{106}_3$ and $\mathbf{106}_5$ in their free positions. Such factors are based on physical phenomena associated with harmonic oscillation and resonance, among others.

Figure 2:
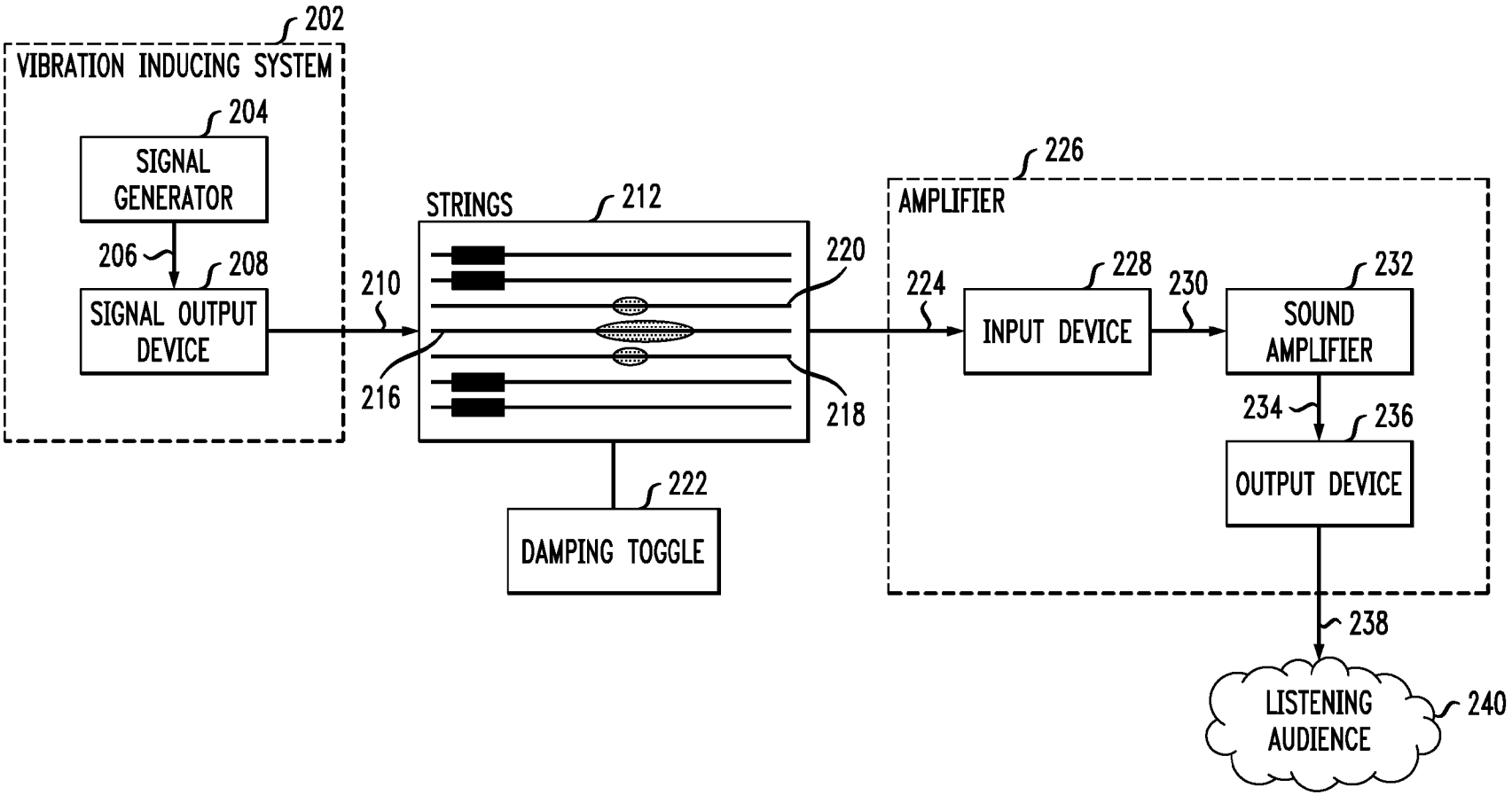
FIG. 2 depicts a stringed instrument utilizing sympathetic vibrations including a vibration inducing system and an amplifier in accordance with another embodiment of the present invention.

FIG. 2 depicts a stringed musical instrument utilizing sympathetic vibrations in accordance with one embodiment of the present invention. In one embodiment, the stringed musical instrument 200 comprises a vibration inducing device 202, a plurality of strings 212, a plurality of dampers 214, and an amplifier 226. Optionally, as described above, the musical instrument 200 further comprises a damping toggle for controlling the dampers 214.

In one embodiment, the vibration inducing device 202 may comprise a signal generator 204 and a signal output device 208. Alternatively, the vibration inducing device 202 may comprise one or more hammers, plectra, or other vibration inducing devices as described hereinabove with reference to previously-described embodiments of the present invention.

The signal generator 204 may comprise an electronic or acoustic waveform generator which takes as an input a shape, intensity, frequency, and/or other factors of a desired signal to be output based on the user's preferences and the application of the signal. The output from the signal generator may comprise a data stream 206, which may include information transmitted via voltage and/or current values and differences, which is sent to the signal output device 208 for translation and subsequent output.

Once the data stream 206 is translated into a signal by the signal output device 208, it is output as the user's desired vibration signal 210. The signal output device 208 may comprise any number of output devices, including but not limited to a speaker, a tuning fork, or any other device capable of inducing a mechanical vibration from an electrical signal in at least a first sting. The signal 210 proceeds to the strings 212 where it may induce vibration in one or more strings.

Generally, the strings 212 may be positioned proximate the dampers 214, which are in communication with the damping toggle 222. The strings 212 may comprise a first string 216 for receiving an initial vibration from the signal 210. In certain embodiments, where a mechanical form of the vibration inducing device 202 is provided, the first string 216 may receive the mechanical force creating vibration therein.

In order for the first string 216 to vibrate, it is generally understood that it may not be in contact with a damper 214. Accordingly, in certain embodiments, the damping toggle 222 may be in communication with the vibration inducing device 202, such that the damping toggle 222 releases the damper 214 on the first string 216 when the vibration inducing device 202 provides a signal therefor.

Similarly, in order for one or more proximate strings 218 to resonate with sympathetic vibration, the dampers 214 must not be in contact with those strings 218 either. In one embodiment, the damping toggle 222 may be in communication with the vibration inducing device 202, as described above. In another embodiment, the damping toggle 222 may be operated by the user to either release the dampers 214 from the desired proximate strings 218 if the musical instrument 200 is provided with the dampers 214 in a default damping position, or alternatively, used to dampen undesired proximate stings 218 where the musical instrument 200 is provided with the dampers 214 in a default open position.

Generally, the positioning of the dampers 214 on particular proximate strings 218, and those left open to resonate, dictate a "damping configuration" (i.e., chord shapes, scales, or the like) on the strings 212 based on the desired sound the user intends to generate. Accordingly, a damping configuration will allow certain proximate strings 218 to resonate with sympathetic vibrations, while muting others. While certain stringed instruments, such as a guitar, bass guitar, or the like, may allow for natural damping configurations (i.e., using no dampers, and allowing natural harmonics to resonate where they may), other stringed instruments, for example, a piano, may require a particular damping configuration be set, or otherwise an undesirable number of strings may resonate in view of the number of common natural harmonic frequencies extant on a traditional piano.

Once a damping configuration is set and the signal output 210 is sent to the strings 212, one or more fundamental strings 216 may begin to vibrate and emit at least a fundamental tone. Based on the characteristics of the signal output 210 and the damping configuration, one or more sympathetic strings 218, 220 may begin to resonate sympathetically, as described hereinabove, thus emitting one or more sympathetic tones. In one embodiment, depending on the nature of the musical instrument, the output tones 224 from the strings 212 may be output directly to a listening audience 240. In such an embodiment, it may be desirable that the musical instrument include a soundboard, an acoustic resonating chamber or other naturally amplifying component, to provide a listening audience with a sufficiently audible sound.

In another embodiment of the present invention, as depicted in FIG. 2, the output tones 224 resulting from the resonance of one or more of the strings 212 may be output to an amplifier 226. In many embodiments, only the resonating sounds from the proximal strings 218, i.e., those vibrating through induced sympathetic vibrations, are output to the amplifier 226.

In certain embodiments, it may be advantageous to provide onboard tone shaping, equalization, gain staging to the instrument. For example, in one embodiment, a variable band EQ and mixer may be utilized to balance the output of the tones. Similar to a drawbar organ, multiple sources of signal input could be adjusted both in volume and frequency response, in order to alter the timbre of the sound produced, thus yielding improved tonal flexibility.

Generally, the amplifier 226 serves to increase the amplitude of the output tones of any one or more of the strings 212 to facilitate listening by a listening audience 240. The amplifier 226 may comprise an amplifier input device 228, a sound amplifier 232, and an amplifier output device 236. However, any other conventional amplifier configuration may be utilized in connection with embodiments of the present invention without departing from the scope of embodiments of the present invention.

As depicted, the output tones 224 may first enter the amplifier input device 228. Such an amplifier input device 228 may comprise any input device feasible in embodiments of the present invention, including but not limited to electromagnets (as utilized in speakers and guitar pickups), microphones, analog to digital signal converter, combinations thereof, or the like. The amplifier input device 228 may then send a data stream 230 to the sound amplifier 232.

The sound amplifier 232 amplifies or otherwise increases at least the amplitude of the sound wave data transmitted by data stream 230. The amplification may be accomplished through any commonly-known or conventionally-used techniques, for example, with typical electric guitar amplifiers. After the amplification operation is complete, the output from the sound amplifier 232 is an amplified data stream 234. The amplified data stream 234 may then enter the amplifier output device 236.

The amplifier output device 236 may comprise any output device feasible in embodiments of the present invention, including but not limited to a speaker or other transducer. The amplifier output device 236 translates the amplified data stream 234 into an output signal 238 which may then be output and detectable by a listening audience 240. In certain embodiments the amplifier output device 236 may comprise a computer or digital music device, such that an data signal may be recorded, stored, or otherwise output through such a device.

Figure 3:
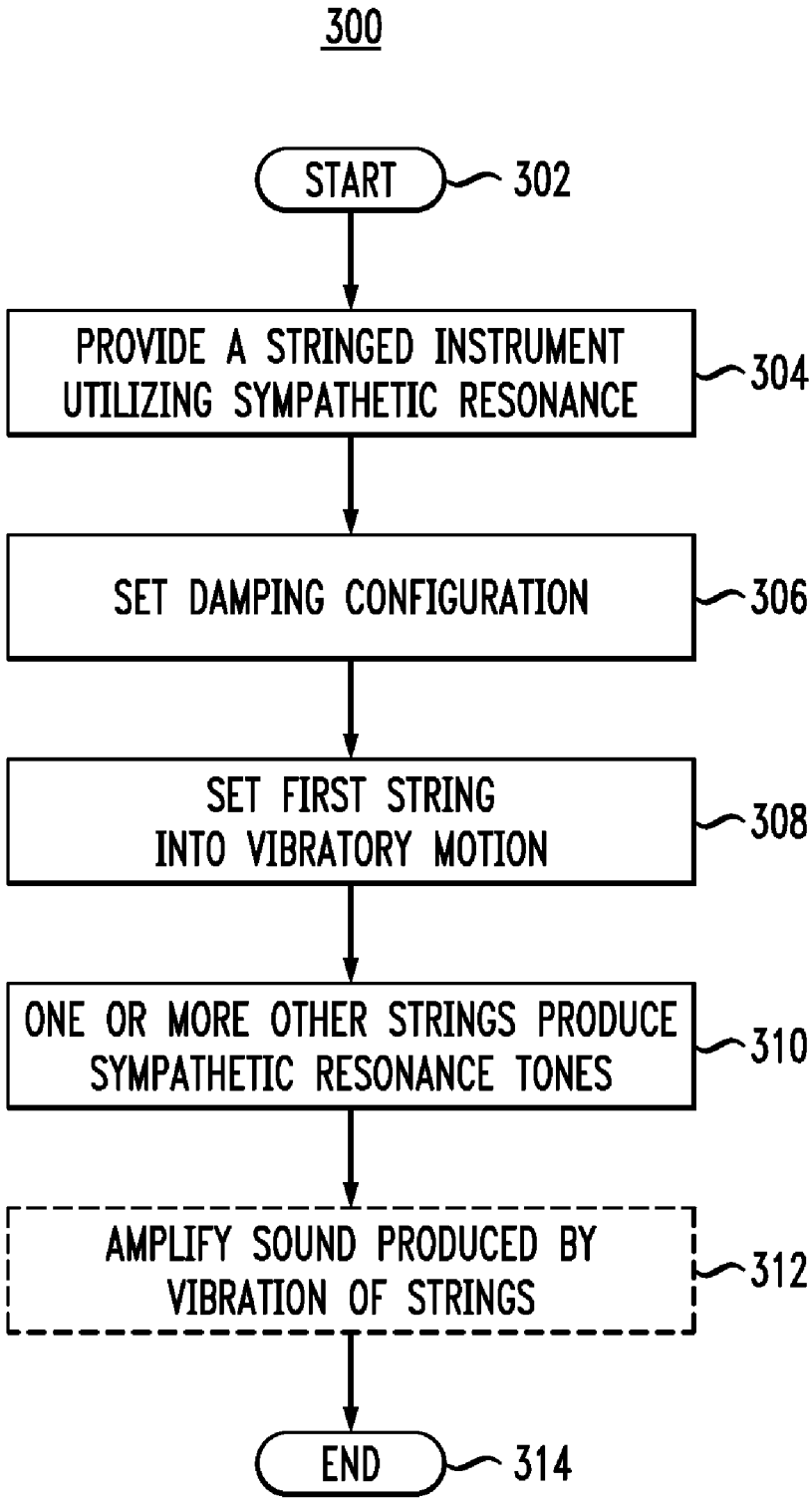
FIG. 3 depicts a method of playing a stringed instrument utilizing sympathetic vibrations in accordance with yet another embodiment of the present invention.

FIG. 3 depicts a method of playing a stringed instrument utilizing sympathetic vibrations in accordance with yet another embodiment of the present invention. The method 300 begins at step 302. At step 304, a stringed instrument utilizing sympathetic resonance is provided. Such a stringed instrument may comprise any stringed instrument in accordance with one or more embodiments of the present invention as hereinabove described. In many embodiments, the stringed instrument may comprise a common stringed instrument such as a guitar, bass guitar, piano or the like. In other embodiments of the present invention, the stringed instrument may comprise more non-traditional types of stringed instruments, including: a banjo, a lute, a zither, a hammered dulcimer, a sitar, a ukulele, or the like.

At step 306, a damping configuration is set with respect to a set of strings on the stringed instrument. The damping configuration may be any configuration described hereinabove with respect to previously-described embodiments of the present invention. Various dampers in the stringed instrument may be set in their free or engaged positions. Like most musical instruments, the user may generally require skill and knowledge of the instrument in order to create a pleasant sound as the result of a particular damping configuration. However, in accordance with embodiments of the present invention, any damping configuration, as discussed above, may be deemed suitable for a particular embodiment of the present invention.

At step 308, a first string, or a fundamental string (or optionally, a plurality of fundamental strings), may be set into vibratory motion. This vibratory motion may be accomplished by way of a vibration inducing device, such as by a hammer or plectrum, or by an electronic signal generator, or by any other vibration inducing device suitable for embodiments of the present invention.

At step 310, in view of the vibration of the fundamental string, and the damping configuration of the other strings, sympathetic resonance tones may be produced. The strings may vibrate as induced from the frequency, amplitude, and other characteristics of the vibration of the first or fundamental string. Depending on the type of musical instrument being played, any number of sympathetic tones may be induced.

In certain embodiments, the method may proceed to optional step 312. At step 312, the tones emitted by the fundamental string(s), the sympathetic string(s), or both may be amplified via an amplifier. The amplifier may comprise a soundboard, an electronic amplification system as described hereinabove, or any other amplification means suitable for embodiments of the present invention. The amplification of the resonant tones produced by one or more of the strings may facilitate listening by a listening audience by making the tones more detectable and audible. The method 300 terminates at step 314.

Although the above embodiments describe stringed musical instruments, further and additional embodiments of the present invention also contemplate the structure and methods of embodiments described herein to occur within any variety of vibrational mediums. In such embodiments, rather than utilizing the vibrating strings to generate a sympathetic tone, other mediums, such as metal tines (e.g., as used on the Rhodes piano, as manufactured by Fender-Rhodes), or glass, wood, crystal, quartz or the like. In further alternative embodiments, generation of a global fundamental tone may occur through mediums such as forced air through a defined volume, or the like.

It should be emphasized that the above-described embodiments of the present invention are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

What is claimed is:

1. A stringed musical instrument, comprising:

a single set of a plurality of strings; and a vibration inducing device configured to create a global fundamental tone upon demand by a user, the vibration inducing device consisting of a non-electrical means for inducing a mechanical vibration;

wherein at least a first string of the single set of the plurality of strings controllably produces a sympathetic resonance in response to the global fundamental tone, the sympathetic response occurring substantially simultaneously with the creation of the global fundamental tone.

2. The stringed instrument of claim 1, further comprising a damper being removably disposed on each of the plurality of strings.

3. The stringed instrument of claim 2, further comprising a damper toggle configured to selectively place or remove at least a damper in contact with at least one of the plurality of strings.

4. The stringed instrument of claim 1, further comprising an amplifier for amplifying the sympathetic resonance of the first string.

5. The stringed instrument of claim 1, further comprising a soundboard disposed adjacent to at least one of the plurality of strings.

6. The string instrument of claim 1, wherein the stringed instrument comprises at least one of a piano, a guitar, or a bass guitar.

7. The string instrument of claim 1, further comprising wherein at least a second string of the plurality of strings produces a sympathetic resonance in response to the global fundamental tone.

8. A piano comprising:

a plurality of keys, each key associated with at least one of a single set of a plurality of strings; and a vibration inducing device configured to vibrate at least a first string of the single set of the plurality of strings upon depression of one of the plurality of keys;

wherein at least a second string of the single set of the plurality of strings produces a sympathetic resonance in response to the vibration of the first string.

9. The piano of claim 8, further comprising a damper being removably disposed on each of the plurality of strings.

10. The piano of claim 9, further comprising a damper toggle configured to selectively place or remove at least a damper in contact with at least one of the plurality of strings.

11. The piano of claim 8, further comprising an amplifier for amplifying the sympathetic resonance of the second string.

12. The piano of claim 8, further comprising a soundboard disposed adjacent to at least one of the plurality of strings.

13. The piano of claim 8, further comprising wherein at least a third string of the plurality of strings produces a sympathetic resonance in response to the vibration of the first string.

14. A method of playing a stringed instrument utilizing sympathetic vibrations, comprising:

providing a stringed instrument, comprising:

a single set of a plurality of strings; and a vibration inducing device configured to create a global fundamental tone upon demand by a user, the vibration inducing device consisting of a non-electrical means for inducing a mechanical vibration, wherein at least a first string of the single set of the plurality of strings controllably produces a sympathetic resonance in response to the global fundamental tone, the sympathetic response occurring substantially simultaneously with the creation of the global fundamental tone;

engaging the vibration inducing device to vibrate the first string; and inducing a sympathetic vibration of the second string.

15. The method of claim 14, further comprising amplifying the sympathetic vibration of the second string.

16. The method of claim 14, wherein the stringed instrument further comprises a soundboard disposed adjacent to at least one of the plurality of strings.

17. The method of claim 14, wherein the stringed instrument further comprises a damper toggle configured to selectively control a damper in contact with the one of the plurality of strings.

18. The method of claim 14, wherein the stringed instrument comprises at least one of a piano, a guitar or a bass guitar.

19. The method of claim 14, further comprising inducing a sympathetic vibration of a third string of the plurality of strings.

20. The method of claim 14, wherein the sympathetic vibration of the second string occurs at a harmonic of the vibration of the first string.

* * * * *